US006862969B1

(12) United States Patent
Graf et al.

(10) Patent No.: US 6,862,969 B1
(45) Date of Patent: Mar. 8, 2005

(54) METHOD AND APPARATUS FOR THE MANUFACTURE OF FIBER BUNDELS

(75) Inventors: Thomas Graf, Ottweiler (DE); Josef Herrmann, Eppelborn (DE); Klaus Heilmann, St. Wendel (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 0 days.

(21) Appl. No.: 09/240,062

(22) Filed: Jan. 29, 1999

(30) Foreign Application Priority Data

Jan. 29, 1998 (DE) ..... 198 03 480

(51) Int. Cl.[7] ..... D01G 1/04

(52) U.S. Cl. ..... 83/23; 83/110; 83/151; 83/913; 83/950

(58) Field of Search ..... 83/151–154, 913, 83/13, 23, 950, 110; 414/753.1; 28/147; 19/0.6, 0.62, 0.64

(56) References Cited

U.S. PATENT DOCUMENTS 1,965,464 A * 7/1934 Koehler ..... 28/147
2,014,947 A * 9/1935 Mcculloch et al.
2,217,766 A * 10/1940 Neff
3,194,101 A * 7/1965 Bush et al. ..... 19/0.6
3,304,821 A * 2/1967 Matino et al. ..... 83/913
3,717,905 A 2/1973 Furbeck
3,822,621 A * 7/1974 Knights et al.
3,951,022 A * 4/1976 Hurtes
3,986,417 A * 10/1976 Anderson, Jr. et al.
4,014,648 A * 3/1977 Walsh et al.
4,044,438 A * 8/1977 Everhart
4,265,151 A * 5/1981 Carruth et al.
4,287,647 A * 9/1981 Rodermund et al. ..... 28/147
4,483,727 A 11/1984 Eickman et al.
4,535,663 A * 8/1985 Shealy
4,806,298 A * 2/1989 Wilkinson et al.
4,987,808 A * 1/1991 Sicka et al.
5,092,207 A * 3/1992 Kikuchi et al.
5,927,819 A * 7/1999 Philipp et al.

FOREIGN PATENT DOCUMENTS

EP 0 411 572 2/1991
EP 0 473 064 3/1992
JP 55142580 * 11/1980

* cited by examiner

*Primary Examiner*—Stephen Choi
(74) *Attorney, Agent, or Firm*—Kenyon & Kenyon

(57) ABSTRACT

The present invention relates to a method for the manufacture of fiber bundles and an apparatus for the performance of the method. A continuous process routine and the reduction of fiber losses is permitted by a method with process steps including taking up and transportation of a fiber bundle strand using one or more feed elements, cutting of the fiber bundle strand into partial bundles of a suitable length, releasing the partial bundles from the feed elements, gripping of the partial bundles using one or more gripping elements and releasing the partial bundles from the gripping elements. The present invention further relates to an apparatus for the performance of the method.

4 Claims, 5 Drawing Sheets

METHOD AND APPARATUS FOR THE MANUFACTURE OF FIBER BUNDELS

FIELD OF THE INVENTION

The present invention relates to a method for the manufacture of fiber bundles and to an apparatus for manufacturing fiber bundles.

RELATED TECHNOLOGY

In known methods for the manufacture of fiber bundles, for example for the manufacture of dialyzers, fiber bundle strands coming out of a spinning apparatus are usually wound on reels, with the fiber bundle strands comprising multiple, generally simultaneously spun fibers. When the fiber bundle on the reel possesses the thickness or number of fibers required for further use, the fiber bundle strand coming out of the spinning machine is cut and the reel changed. While the winding procedure is continued with a new reel, the already wound fiber bundle can be supplied to a further processing unit. This further processing can include, for example, the portioning, making up, the casting of the fiber bundle into a suitable plastic or also the packaging of the fiber bundle. In such a method, it is disadvantageous that the manufacturing process cannot be performed continuously due to the required changing of the reels; this makes it substantially more difficult to automate the whole method. Further disadvantages of the method include that clippings of the fiber bundles due to the oblique cut edges result and that unwanted fiber losses result which are caused by the changing of the reels.

European Patent Application No. EP 0 411 572, describes an apparatus for the manufacture of fiber bundles with two cylinders disposed in parallel, of which the one serves as the cutting apparatus and the other carries on its surface the fiber bundle strand coming out of the spinning machine. The cylinder designed as a cutting apparatus possesses blades extending in a radial direction by means of which the separation of the fiber strand is performed in the region between the two cylinders in portions of a desired length. The partial bundles cut in this way are removed from the blades or from the cylinder supporting the blades by means of discharge elements disposed between two blades and can be caught in a suitable collection device. The discharge elements can be moved in the radial direction of the cylinder relative to the blades and cause the blades to protrude radially in the cutting position in the region between the two cylinders and effect the desired cut of the fiber bundle strand. In regions at a distance to the cutting position, the blades are accepted in each case between two discharge elements. Disadvantages of such an apparatus are that it has a relatively complex design and that the change in the length of the partial bundles requires the cylinder supporting the blades to be changed.

SUMMARY OF THE INVENTION

It is an object of the present invention to further develop a method and an apparatus for the manufacture of fiber bundles in such a way that a continuous process routine is possible and that fiber losses can be largely prevented.

The present invention thus provides a method in which a fiber bundle strand is taken up and transported by one or more feed elements, the fiber bundle strand is cut into partial bundles of a suitable length, the partial bundles are released from the feed elements, are gripped by one or more gripping elements, and are released from these gripping elements. The method in accordance with the present invention thus possesses the advantage that the use of reels, which lead to clippings and to fiber losses, can be omitted. Moreover, the continuous design of the total manufacturing process is easily possible, which permits the corresponding automation of the total apparatus. Unlike the use of reels, another advantage is produced from a loose structure of the bundled fibers being able to be achieved. This loose structure can substantially improve the performance rating of the fiber bundle, when used for example, in a dialysis machine.

In addition to a possible process sequence which first provides for the taking up and transportation of a fiber bundle strand using one or more feed elements, and subsequent to this the cutting of the fiber bundle strand into partial bundles, in an alternative embodiment the cutting into partial bundles takes place first, and then the cut partial bundles are taken up and transported, using one or more feed elements. The feed elements can, for example, be designed as gripping devices movable in the direction of transportation.

One substantial advantage of the method in accordance with the present invention includes that the manufacturing steps following the spinning process also can be performed continuously. Both the taking up and transportation, and the cutting and release of the partial bundles, can be performed continuously so that no discontinuous process step exists which would stand in the way of a continuous design of the total method.

In accordance with a preferred embodiment of the present invention, partial bundles are put into a collection trough of a collection device after their release from the gripping elements. After the transfer of the partial bundles from the transportation elements to the gripping elements, the partial bundles can, after the release of the partial bundles from the gripping elements, be placed into a collection trough or any suitable collection device whose cross-section can roughly correspond to the desired thickness of the fiber bundles to be manufactured.

It is particularly advantageous if the feed elements and the gripping elements are moved during the release and during the gripping of the partial bundles using the gripping elements at the same speed in the transportation direction of the partial bundles, and if the speed of the gripping elements is reduced after the gripping of the partial bundles. The movement with the same speed allows the exact transfer of the fiber bundle cut into partial bundles and effectively prevents any misalignment of individual fibers during the transfer. In accordance with the present invention, in this case, the feed and gripping elements run at the same speed in the same direction at least for the time of the transfer. Subsequent to this transfer, the speed of the gripping elements can be reduced after the gripping of the partial bundles, whereby a release and placing of the partial bundles in a suitable collection device or storage space is prepared.

In accordance with a preferred embodiment of the present invention, the gripping elements are not moved in the transportation direction of the fiber bundle strand during the release of a partial bundle. In this way, it is possible that a partial bundle to be placed in a collection device or a trough disposed therein can be positioned exactly and that relative movements between the collection device and the partial bundle in the direction of transportation are avoided.

In another embodiment of the present invention, the collection device is rotated after filling a first collection trough, and of one or more further collection troughs can then be filled. When the desired bundle thickness or number of fibers in one trough has been achieved, the collection device is rotated and a further collection trough released for filling with the partial bundles. Simultaneously, the fiber bundle can be taken out of the trough previously filled and supplied for further processing. Thus, there is no interruption to the process which would make a discontinuous performance of the total process necessary in this method step.

In another embodiment of the present invention, the partial bundles put down are held in the collection troughs of the collection device using a retaining apparatus. Here, the retaining apparatus only releases the collection trough during the filling and so effects a secure fixing of the partial bundles already put down.

The present invention further relates to an apparatus for the manufacture of fiber bundles with one or more feed elements to take up and transport a fiber bundle strand, with one or more gripping elements, where the feed elements can be moved in the direction of transportation of the fiber bundle strand and the gripping elements can be moved at least in one other or differing direction, with a cutting apparatus to separate the fiber bundle strand into partial bundles, and with a device to take up the partial bundles cut off. While the feed elements grip the fiber bundle strand coming out of the spinning apparatus and move it in the direction of a collection device, the gripping elements essentially serve to take over the cut partial bundle and to place it exactly in the collection device. For this purpose, it is desirable for the gripping elements to be movable at least in one direction different from the direction of transportation of the fiber bundle strand. It is advantageous if the gripping elements can be moved in one plane which extends perpendicular to the direction of transportation of the fiber bundle strand. It is thus possible to take over the partial bundles from the feed elements, to reduce the speed in the direction of transportation and, finally, to put these partial bundles down at an exactly pre-determinable position in a collection device.

It is particularly advantageous if the gripping elements can be moved in the direction of transportation of the partial bundles at the same speed as the feed elements. In this way, the transfer of the partial bundle from the feed elements to the gripping elements is possible without any problems since, during this process, the feed and gripping elements move at the same speed, so that a gripping of the partial bundle at the desired point is easily possible, For this purpose, the gripping elements are accelerated in the direction of transportation of the partial bundles prior to the transfer and slowed down correspondingly after the performance of the transfer and before the putting down of the partial bundle. Prior to the release of the partial bundle into the collection device, the gripping elements are advantageously no longer moved in the direction of transportation. In this way, an exact positioning of the partial bundle to be put down in the collection device is ensured.

The feed elements and the gripping elements can in each case comprise a first gripping arm and a second gripping arm movable relative thereto. Here, it is possible for the first and second gripping arms to be moved in a translatory manner towards or away from each other. It is equally feasible for one or both gripping arms to be designed in a pivotable manner.

It is particularly advantageous if the collection device comprises at least two plates in which collection troughs are disposed in the circumferential direction and between which the gripping elements can be moved. Here, the partial bundles already taken into the collection trough extend between the two plates of the collection device and can be positioned here at a suitable point by the gripping elements without the collection device hindering the movability of the gripping elements.

In another embodiment of the present invention, the plates of the collection device can be rotated. In this way, it is possible by rotating the collection device to release another, empty collection trough, after the filling of one collection trough without having to interrupt the process.

In accordance with a preferred embodiment of the present invention, a retaining apparatus is provided by which the collection troughs can be covered and which can be moved relative to the collection troughs. It is thus ensured that the partial bundles already taken up in a collection trough are held securely therein. If a new partial bundle is introduced to a collection trough, the retaining apparatus is removed from the opening of the collection trough for this purpose to allow insertion.

BRIEF DESCRIPTION OF THE DRAWINGS

Further details and advantages of the present invention are explained in more detail through an example embodiment shown in the drawings, in which.

DETAILED DESCRIPTION OF THE PREFERRED ELEMENTS

Figure 1:
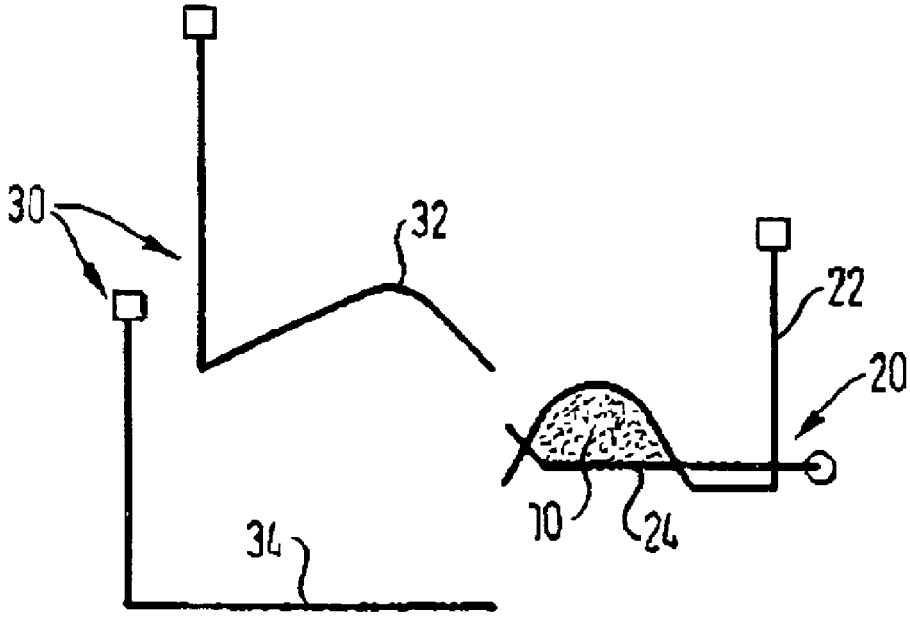
FIG. 1 shows a diagram representation of the positions of a feed element designed as a gripping device, a gripping element and the retaining apparatus with collection device prior to the release of the partial bundle from the feed element.
Figure 1:
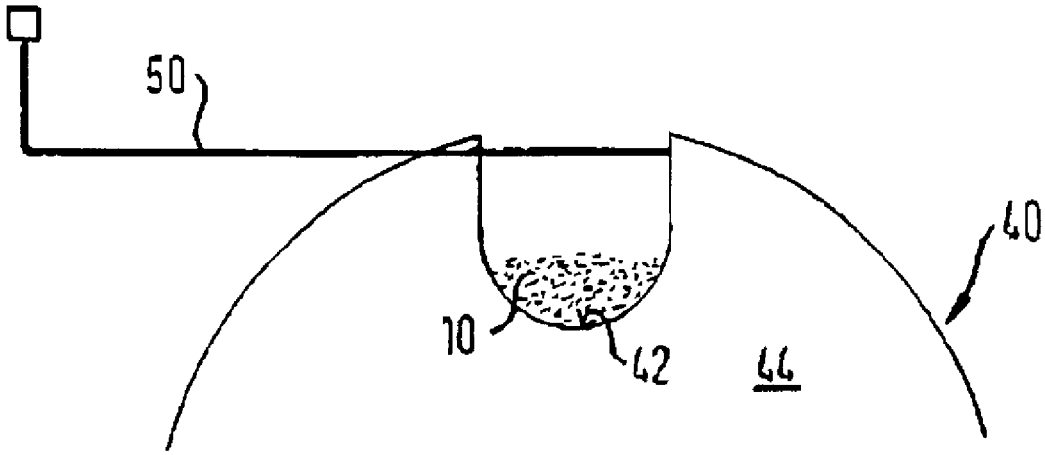

FIG. 1 shows the positions of a feed element 20 and of a gripping element 30 during the fixing of a partial bundle 10 of a fiber bundle by the feed element 20. In accordance with the present embodiment, the feed element 20 is also designed as a gripping device and comprises a first gripping arm 22 and a second gripping arm 24, with the first gripping arm 22 being only movable in a translational manner and the second gripping arm 24 being movable in a translational manner and also being pivotable. The gripping element 30 comprises a first gripping arm 32 and a second gripping arm 34, both being movable in a translational manner.

FIG. 1 further shows a collection device 40 with plates 44, of which only the front of the two plates 44 is shown in FIG.

1. In plate 44, a collection trough 42 is located in which partial bundles 10 already deposited are to be removed. The partial bundles 10 are fixed in place by a retaining apparatus 50 which extends tangentially over the collection trough 42. In accordance with the present embodiment, the retaining device 50 can be moved in a translatory manner; however, it can equally be disposed pivotably.

The present embodiment of FIG. 1 shows a position of the apparatus in accordance with the present invention in which the fiber bundle 10 is transported by the feed element 20 in a direction which extends perpendicularly to the plane of the paper of FIG. 1. In this position, the gripping element 30 and the retaining apparatus 50 are at rest.

Figure 2:
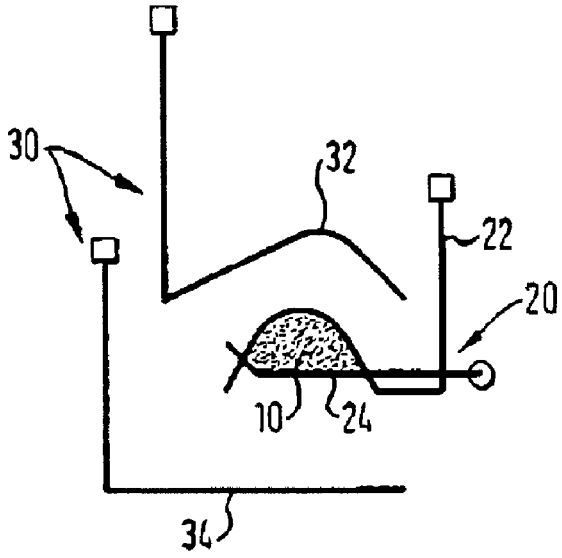
FIG. 2 shows a diagram representation of the positions of a feed element, the gripping element and the retaining apparatus with collection device after the moving of the gripping element directly prior to the release of the partial bundle by the feed element.
Figure 2:
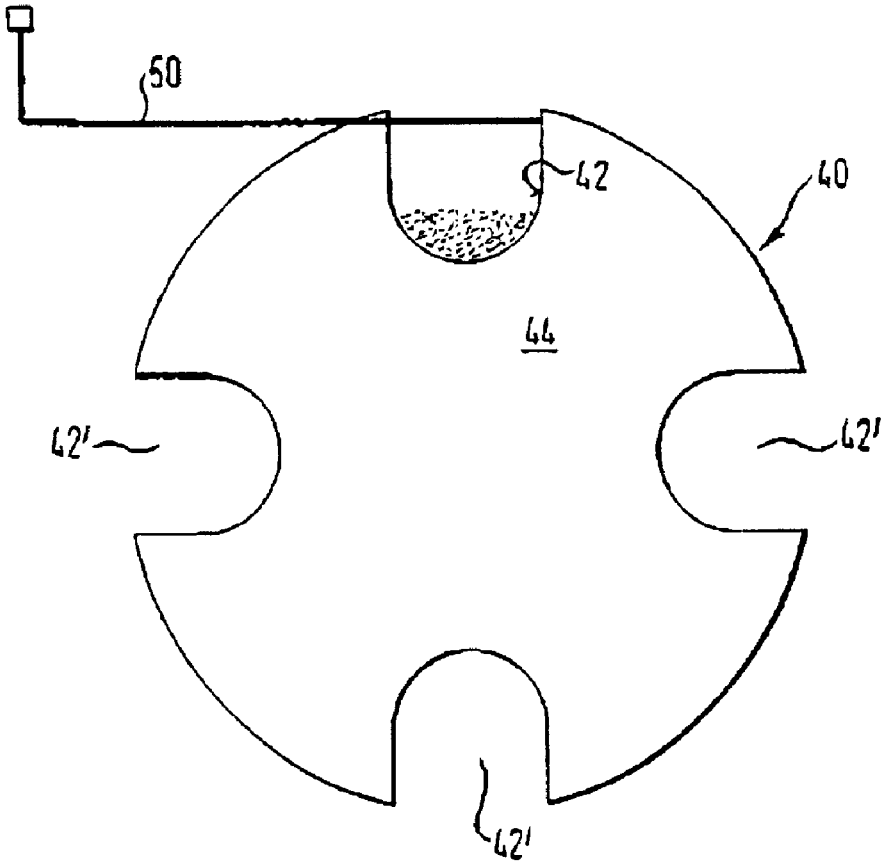

FIG. 2 shows the position of the apparatus in accordance with the present invention after the gripping element 30 has moved in a direction towards the feed element 20 or the partial bundle 10. In this position, the first gripping arm 32 and the second gripping arm 34 of the gripping element 30 extend in a region above and below the partial bundle 10, which is still fixed in place by the feed element 20. During or after the movement of the gripping element 30 in a direction towards the feed element 20, the gripping element 30 is accelerated in the direction of transportation of the partial bundle, with the direction of transportation in accordance with the present embodiment extended perpendicularly to the plane of the paper of FIG. 2. At this stage, the retaining apparatus 50 is still located in a position in which the collection trough 42 of the plate 44 of the collection device 40 is covered. FIG. 2 illustrates that in the circumferential direction of the plate 44, a total of four collection troughs 42, 42' are disposed which can accordingly be filled one after the other and thus allow a continuous process routine.

Figure 3:
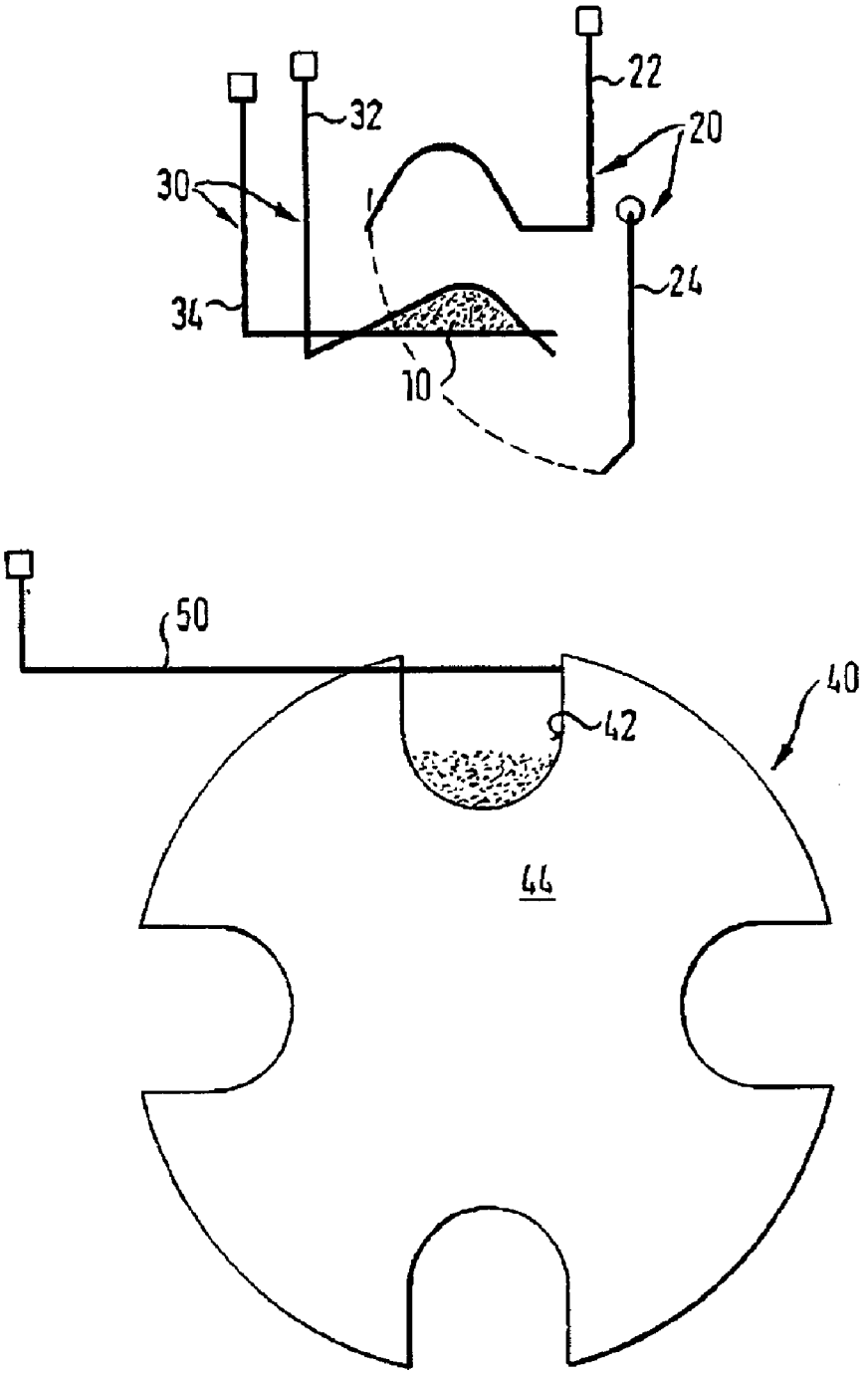
FIG. 3 shows a diagram representation of the positions of the feed element, the gripping element and the retaining apparatus with collection device after the release of the partial bundle from the feed element and the gripping using the gripping element.

In FIG. 3, the positions of the feed and gripping elements 20, 30 are shown after the partial bundle 10 has been released from the feed element 20 by pivoting the second gripping arm 24 and is being held in the gripping element 30 by a vertical movement of the gripping arms 32, 34. To allow an exact transfer of the partial bundle 10, in the transfer position of FIG. 3, the feed element 20 and the gripping element 30 move advantageously at the same speed in the direction of transportation of the partial bundle. The retaining apparatus 50 is still located in the position of FIG. 1 and FIG. 2 at this stage.

Directly after the transfer of the partial bundle 10 to the gripping element 30, the latter is slowed down in the direction of transportation of the fiber bundle and moved in a plane perpendicular thereto in a direction toward the collection trough 42.

Figure 4:
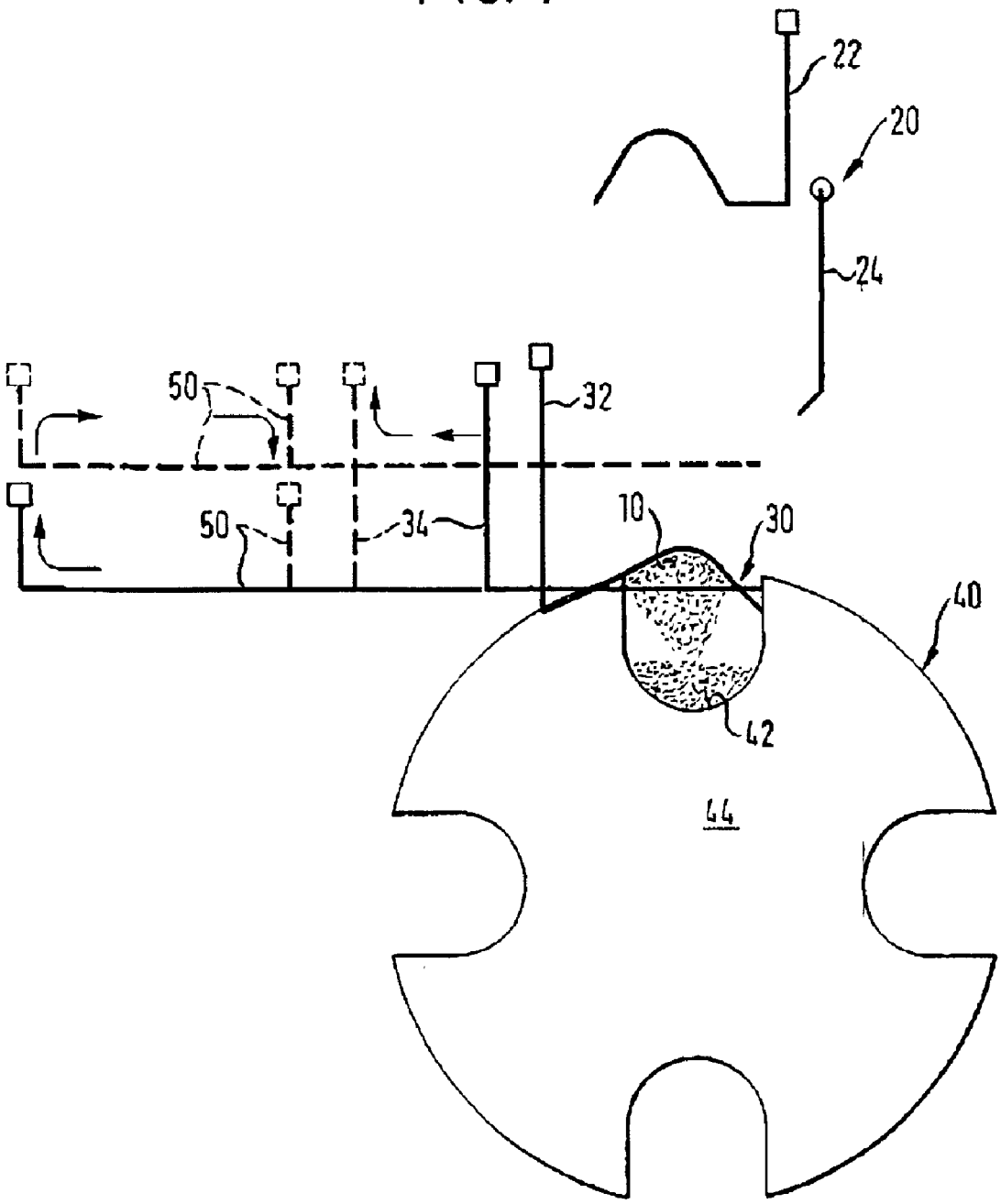
FIG. 4 shows a diagram representation of the positions of the feed element, the gripping element and the retaining apparatus with collection device during the release of the partial bundle from the gripping element into a collection trough.

FIG. 4 shows a position of the feed element 20, the gripping element 30 and the retaining apparatus 50 after the release of the collection trough by a horizontal movement of the retaining apparatus 50. At the same time, the partial bundle 10 is led in a direction towards the collection trough 42 by a vertical movement of the gripping element 30. During the release of the partial bundle, the gripping element 30 is advantageously not moved in the direction of transportation of the partial bundle in order to allow an exact positioning in the collection trough 42.

Subsequent to the release of the partial bundle into the collection trough 42, the retaining apparatus 50 is raised from its position as shown in FIG. 4, moved horizontally over from its starting position shown in FIG. 1, and finally led vertically into the starting position as indicated in FIG. 4 by the broken lines. Simultaneously, the second gripping arm 34 of the gripping element 30 is moved horizontally out of the region of the collection trough 42, whereby the partial bundle 10 is introduced into the collection trough 42 and fixed in place therein by the retaining apparatus 50.

Figure 5:
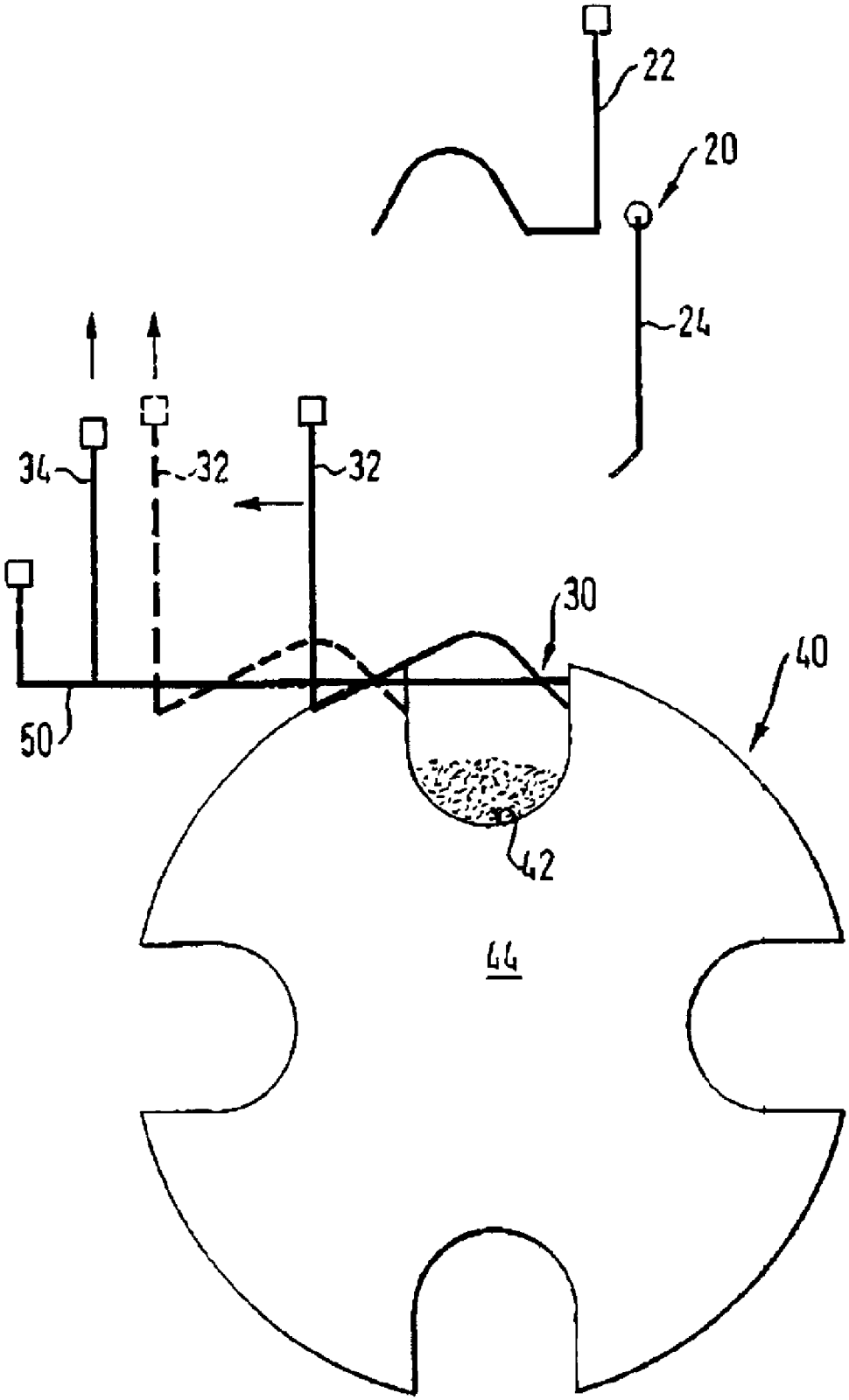
FIG. 5 shows a diagram representation of the positions of the feed element, the gripping element and the retaining apparatus with the collection device after the putting down of the partial bundle into the collection trough and after covering the collection trough using the retaining apparatus.

This position of the second gripping arm 34 is shown in FIG. 4 by broken lines and in FIG. 5 by solid lines. Subsequent to this, the first gripping arm 32 of the gripping element 30 is also moved horizontally in the direction of the second gripping arm 34 until the position indicated by a broken line in FIG. 5 is reached. Subsequently, both gripping arms 32, 34 are moved vertically upwards and against the direction of transportation of the fiber bundle until they assume the position shown in FIG. 1.

When the required number of partial bundles 10 has been taken up in the collection trough 42, the plate 44 or the collection device 40 is rotated and thus a new collection trough 42' is released for filling. Simultaneously, the fiber bundle released from collection trough 42 can be supplied to a further processing unit.

What is claimed is:

1. A method for manufacturing a fiber bundle having a fiber bundle length from a required number of unbound partial bundles, the method comprising:

(a) transporting at a first speed a fiber bundle strand using at least one feed element;

(b) pre-cutting the fiber bundle strand into unbound partial bundles, the unbound partial bundles having a length when pre-cut equal to the fiber bundle length;

(c) releasing the unbound partial bundles from the at least one feed element;

(d) gripping the unbound partial bundles using at least one gripping element and moving the unbound partial bundles at a speed that is less than the first speed;

(e) releasing the unbound partial bundles from the at least one gripping element; and (f) placing the unbound partial bundles in a first collection trough of a collection device; and (g) repeating steps (a) to (f) for the required number of unbound partial bundles until a required thickness of the fiber bundle is obtained in the first collection trough.

2. A method for manufacturing fiber bundles having a fiber bundle length comprising the steps of:

transporting at a first speed a fiber bundle strand using at least one feed element;

pre-cutting the fiber bundle strand into unbound partial bundles, the unbound partial bundles having a length when pre-cut equal to the fiber bundle length;

releasing the unbound partial bundles from the at least one feed element;

gripping the unbound partial bundles using at least one gripping element;

moving the unbound partial bundles at a speed that is less than the first speed;

releasing the unbound partial bundles from the at least one gripping element;

placing the unbound partial bundles having the same lengths in a first collection trough of a collection device; and rotating the collection device after the first collection trough is filled and placing the unbound partial bundles in a further collection trough of the collection device.

3. A method for manufacturing a filter element for a dialyzer, the filter element including a fiber bundle having a fiber bundle length from a required number of unbound partial bundles, the method comprising:

(a) transporting at a first speed a fiber bundle strand using at least one feed element;

(b) pre-cutting the fiber bundle strand into unbound partial bundles, the unbound partial bundles having a length when pre-cut equal to the fiber bundle length;

(c) releasing the unbound partial bundles from the at least one feed element;

(d) gripping the unbound partial bundles using at least one gripping element and moving the unbound partial bundles at a speed that is less than the first speed;

(e) releasing the unbound partial bundles from the at least one gripping element; and (f) placing the unbound partial bundles In a first collection trough of a collection device; and (g) repeating steps (a) to (f) for the required number of unbound partial bundles until a required thickness of the fiber bundle is obtained in the first collection trough.

4. A method for manufacturing a filter element for a dialyzer, the filter element including fiber bundles having a fiber bundle length comprising the steps of:

transporting at a first speed a fiber bundle strand using at least one feed elements;

pre-cutting the fiber bundle strand into unbound partial bundles, the unbound partial bundles having a length when pre-cut equal to the fiber bundle length;

releasing the unbound partial bundles from the at least one feed element;

gripping the unbound partial bundles using at least one gripping element;

moving the unbound partial bundles at a speed that is less than the first speed;

releasing the unbound partial bundles from the at least one gripping element;

placing the unbound partial bundles having the same lengths in a first collection trough of a collection device; and rotating the collection device after the first collection trough is filled and after the unbound partial bundles in a further collection trough of the collection devices.

* * * * *

UNITED STATES PATENT AND TRADEMARK OFFICE

CERTIFICATE OF CORRECTION

PATENT NO. : 6,862,969 B1
DATED : March 8, 2005
INVENTOR(S) : Graf et al.

It is certified that error appears in the above-identified patent and that said Letters Patent is hereby corrected as shown below:

Title page, Item [54] and Column 1, line 2,
Title, change "BUNDELS" to -- BUNDLES --.

Signed and Sealed this

Sixth Day of December, 2005

JON W. DUDAS
*Director of the United States Patent and Trademark Office*